US007243621B2

(12) United States Patent
Geyer

(10) Patent No.: US 7,243,621 B2
(45) Date of Patent: Jul. 17, 2007

(54) TWO-STROKE ENGINE

(75) Inventor: Werner Geyer, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/333,307

(22) Filed: Jan. 18, 2006

(65) Prior Publication Data

US 2006/0157005 A1 Jul. 20, 2006

(30) Foreign Application Priority Data

Jan. 18, 2005 (DE) ..... 10 2005 002 272

(51) Int. Cl.
*F02B 33/04* (2006.01)
*F02P 3/02* (2006.01)

(52) U.S. Cl. ..... 123/73 B; 123/647; 123/73 PP

(58) Field of Classification Search ..... 123/73 PP, 123/73 B, 73 A, 73 C, 65 R
See application file for complete search history.

(56) References Cited

U.S. PATENT DOCUMENTS 5,000,133 A * 3/1991 Kawamura ..... 123/65 VC
5,007,382 A * 4/1991 Kawamura ..... 123/21
5,062,396 A * 11/1991 Duret et al. ..... 123/73 BA
5,113,805 A * 5/1992 Kawamura ..... 123/21
5,857,449 A * 1/1999 Ishikawa et al. ..... 123/557
6,758,170 B1 * 7/2004 Walden ..... 123/21
6,851,402 B2 2/2005 Rosskamp
7,017,537 B2 * 3/2006 Osburg et al. ..... 123/73 A

* cited by examiner

*Primary Examiner*—Stephen K. Cronin
*Assistant Examiner*—Hyder Ali
(74) *Attorney, Agent, or Firm*—Walter Ottesen

(57) ABSTRACT

A two-stroke engine (1, 31, 41, 51) includes a cylinder (2) having a combustion chamber (5). The combustion chamber (5) is delimited by a piston (7) which drives a crankshaft (25) rotatably journalled in a crankcase (3). The two-stroke engine (1, 31, 41, 51) includes a fuel line (14) wherein an electromagnetic valve (18) is mounted. The valve (18) is controlled by a control unit. An air channel (27) is provided for supplying combustion air. The two-stroke engine (1, 31, 41, 51) has at least one transfer channel (12) which connects the combustion chamber (5) to the crankcase (3) at pregiven piston positions. An ignition module (20, 30) is provided which triggers the ignition of a spark plug (8) projecting into the combustion chamber (5). The valve (18) and the control of the valve (18) are integrated into the ignition module (20, 30).

20 Claims, 4 Drawing Sheets

TWO-STROKE ENGINE

CROSS REFERENCE TO RELATED APPLICATION

This application claims priority of German patent application no. 10 2005 002 272.3, filed Jan. 18, 2005, the entire content of which is incorporated herein by reference.

FIELD OF THE INVENTION

The invention relates to a two-stroke engine especially in a handheld work apparatus such as a motor-driven chain saw, cutoff machine or the like.

BACKGROUND OF THE INVENTION

A two-stroke engine is known from U.S. Pat. No. 6,851,402 to which fuel is supplied via an electronically controlled injection valve. The injection valve opens with an injection nozzle into the transfer channel. The injection takes place in dependence upon the engine speed (rpm) at pregiven positions of the piston. Accordingly, the control of the injection valve is connected to a unit which determines the rpm of the crankshaft.

SUMMARY OF THE INVENTION

It is an object of the invention to provide a two-stroke engine which has a simple configuration.

The two-stroke engine of the invention includes: a cylinder; a piston mounted in the cylinder to undergo a reciprocating movement along a stroke path between top dead center and bottom dead center during the operation of the engine; the cylinder and the piston conjointly delimiting a combustion chamber; a crankcase connected to the cylinder; a crankshaft rotatably mounted in the crankcase; the piston being connected to the crankshaft for imparting rotational movement to the crankshaft; a fuel tank; a fuel line for conducting fuel from the fuel tank; an electromagnetic valve mounted in the fuel line; an air channel for supplying combustion air to the engine; a transfer channel for connecting the combustion chamber to the crankcase at pregiven positions of the piston; a spark plug projecting into the combustion chamber; a control unit for controlling the electromagnetic valve; an ignition module for triggering the ignition of the spark plug; and, the control unit and the electromagnetic valve being integrated into the ignition module.

The ignition module triggers the ignition of the spark plug. For this purpose, the ignition module has a coil in which a voltage is induced by the rotation of the crankshaft at pregiven positions of the piston. The rpm of the crankshaft can be determined from the time-dependent course of the induced voltage. Accordingly, the induced voltage can function as an input signal for the control of the electromagnetic valve. A simple configuration of the two-stroke engine can be achieved in that the valve and the control unit of the valve are integrated into the ignition module. In this way, connecting leads between the valve, the control unit and the ignition module are unnecessary. The complexity of assembly, especially the complexity for the wiring of the components is reduced and the potential for a defect in the wiring of the components is considerably reduced.

Preferably, the valve is mounted with the ignition module in a common housing. However, it can also be practical that the ignition module and the valve are cast with each other.

It is practical that a CPU, that is, a central processing unit, is integrated into the ignition module. Via the CPU, the ignition time point of the spark plug as well as the time point at which the two-stroke engine is supplied with fuel via the electromagnetic valve can be controlled. With the arrangement of a CPU in the ignition module, the fuel introduction and the ignition can be controlled and can be so matched to each other that an optimal running performance of the two-stroke engine results. Other operations (which are to be controlled) of the apparatus, on which the two-stroke engine is mounted, can also be carried out by the CPU. In a portable handheld work apparatus such as a motor-driven chain saw or the like, this can, for example, be the control of the handle heater or the collection of operating data and preparing these operating data for readout when servicing the work apparatus.

The ignition module is advantageously mounted on the cylinder in the region of a transfer channel. In this region, the valve can introduce the fuel into the transfer channel. The lead to the spark plug can be configured to be short. At the same time, the ignition module can be mounted in the peripheral region of a fan wheel so that a good cooling of the ignition module results. A fuel pump is mounted upstream of the valve. The fuel pump moves fuel from the fuel tank to the valve and ensures that the fuel, which is introduced into the two-stroke engine, is under a certain pressure and is well atomized. The fuel pump is advantageously a membrane pump which is connected via a pulse line to a region of the two-stroke engine wherein a fluctuating pressure is present. No additional energy is needed for operating the membrane pump; instead, the pressure fluctuations present in the two-stroke engine can be used. This is especially advantageous in portable handheld work apparatus wherein no additional energy supply such as a battery or the like is available.

Advantageously, the valve is connected via a pressure controller to the fuel pump. In this way, and in a simple manner, a constant pressure is ensured at the valve. Especially, the pressure controller is connected to the fuel tank via a return line. In this way, the fuel can flow back into the tank when the pressure is too high.

An advantageous arrangement results when the fuel pump is integrated into the ignition module. The pulse line advantageously opens into the transfer channel. In this way, a short path for the pulse line results so that the pressure drop in the pulse line is low and a good pumping result is obtained. The ignition module need only be connected via a fuel line to the fuel tank. Additional line connections for the fuel are not needed so that a simple configuration of the two-stroke engine and a simple assembly result.

It can, however, also be practical that the fuel pump is mounted in the fuel tank. This facilitates the starting of the pump. The fuel pump can, however, also be mounted on the crankcase. The pulse line opens especially into the crankcase. It is practical to integrate the pulse line in a connecting flange of the fuel pump mounted on the crankcase. In this way, a high pressure is achieved in the pulse line so that a good pumping result is obtained.

A throttle flap is pivotally journalled in the intake channel and the fuel pump is mounted in the throttle flap housing. The pulse line is configured in the connecting stub for the air channel. In this way, no separate lines for the pulse line are needed and the pulse line can be configured to be short. During operation of the two-stroke engine, lower temperatures are present in the region of the throttle flap housing so that an improved cooling of the fuel pump is achieved. In this way, vapor bubbles, which form in the fuel, are reduced.

To ensure that the two-stroke engine can be easily started, it is provided that the valve is open in the deenergized state. At first, no voltage is applied to the valve when starting the two-stroke engine. The voltage must be induced at the ignition module by the manual start-up. No starting of the two-stroke engine is possible before the voltage is not sufficient to open a currentless closed valve. For a valve open in the currentless state, the fuel can, in contrast, be drawn by suction into the combustion chamber by the applied underpressure so that an ignitable mixture can be made ready sooner. Advantageously, the valve projects into the transfer channel. For this reason, the ignition module, which is mounted at the transfer channel, can be configured to be compact. At the same time, the position of the valve in the transfer channel is favorable in order to generate a combustible mixture and to introduce fuel into the crankcase for lubrication. An injection nozzle is mounted downstream of the valve and this injection nozzle projects into the transfer channel. The arrangement of an injection nozzle can improve the atomization of the fuel and therefore the mixture preparation. The valve is especially integrated into the injection nozzle so that the number of components is reduced.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
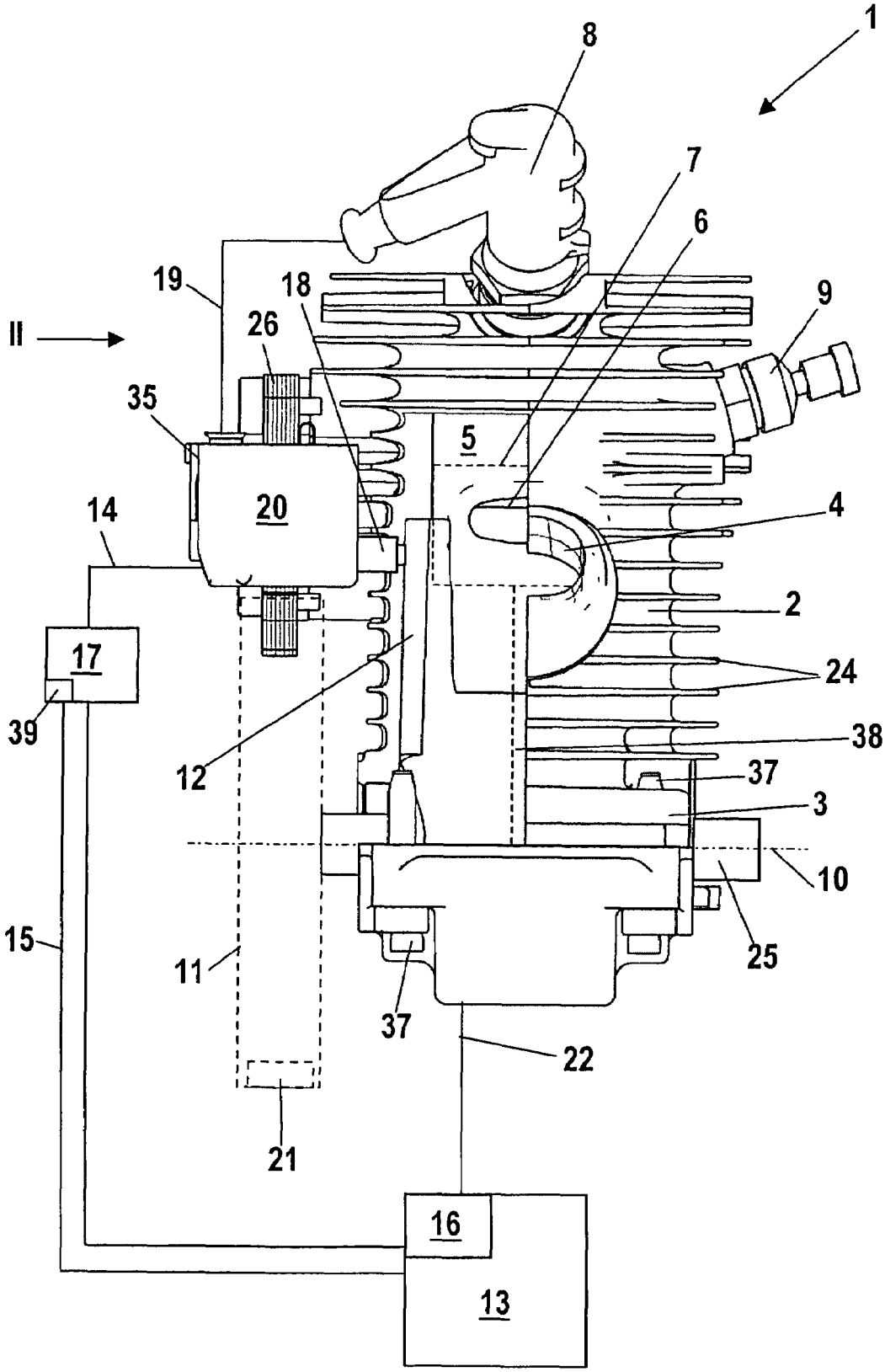
FIG. 1 is a schematic of a two-stroke engine with the cylinder being shown partially cut away.

The two-stroke engine 1 shown in FIG. 1 has a cylinder 2 which is connected to a crankcase 3 via screws 37. A piston 7 is shown in phantom outline in FIG. 1 and is journalled in the cylinder 2 to move back and forth. The piston 7 drives the crankshaft 25 via the connecting rod 38 also indicated in phantom outline in FIG. 1. The crankshaft 25 is rotatably journalled about the crankshaft axis 10 in the crankcase 3. The two-stroke engine 1 has an inlet 4 via which combustion air is supplied to the two-stroke engine 1. For this purpose, the inlet 4 is connected via a piston pocket (not shown in FIG. 1) to at least one transfer channel 12. The transfer channel 12 connects the crankcase 3 to the combustion chamber 5 in the region of bottom dead center of the piston 7. The piston pocket connects the inlet 4 to the end of the transfer channel 12, which opens into the combustion chamber 5, in the region of top dead center of the piston 7. The exhaust gases are conducted away from the combustion chamber 5 through the outlet 6.

A spark plug 8 projects into the combustion chamber 5 and is connected to an ignition module 20 via a lead 19. The ignition module 20 is fixed on the cylinder 2 in the region of the transfer channel 12. The ignition module 20 includes a sheet metal packet 26 having a winding (not shown). The sheet metal packet 26 is mounted at the periphery of the fan wheel 11 (shown in phantom outline in FIG. 1) fixed to the crankshaft 25. On its periphery, the fan wheel 11 has at least one magnet 21 which induces a voltage in the winding of the sheet metal packet 26. The induced voltage triggers the ignition of the spark plug 8. For determining the ignition time point, the ignition module 20 has a control unit, especially a CPU, with which the ignition time point can be controlled in dependence upon the rpm of the two-stroke engine. The control unit is mounted in the housing 35 of the ignition module 20.

An electromagnetic valve 18 is integrated into the ignition module 20. The electromagnetic valve 18 is especially mounted in the housing 35 of the ignition module 20. The valve 18 can, however, also be cast with the ignition module 20. The electromagnetic valve 18 is driven by a control unit which is likewise integrated into the ignition module 20 and this control unit is advantageously the CPU which controls also the ignition time point. The valve 18 opens into the transfer channel 12. The valve 18 is fed by a fuel line 14 which is connected via a fuel store 17 to the fuel pump 16 mounted in the fuel tank 13. The fuel store 17 advantageously has a pressure controller 39 which is connected via a return line 15 to the fuel tank 13. The fuel pump 16 is connected via a pulse line 22 to the crankcase interior space. The fuel pump 16 is configured as a membrane pump and is driven by the fluctuating pressure in the crankcase 3. However, a pump having a different configuration can be utilized as the fuel pump 16. The fuel pump 16 pumps the fuel from the fuel tank 13 into the fuel store 17 from where it reaches the transfer channel 12 via the fuel line 14 and the valve 18. The fuel pump 16 can also be connected directly to the valve 18 without a fuel store being connected therebetween. A decompression valve 9 projects into the combustion chamber 5. The combustion chamber 5 is vented via the decompression valve 9 so that, when starting the engine, the piston 7 in the cylinder 2 need not be moved against the pressure in the combustion chamber 5.

The ignition module 20 is mounted at the outer periphery of the fan wheel 11 in the region of the transfer channel 12. In this region, the ignition module 20 is well cooled by the cooling air flow. The cylinder 2 has cooling ribs 24 for providing an excellent dissipation of heat.

Figure 2:
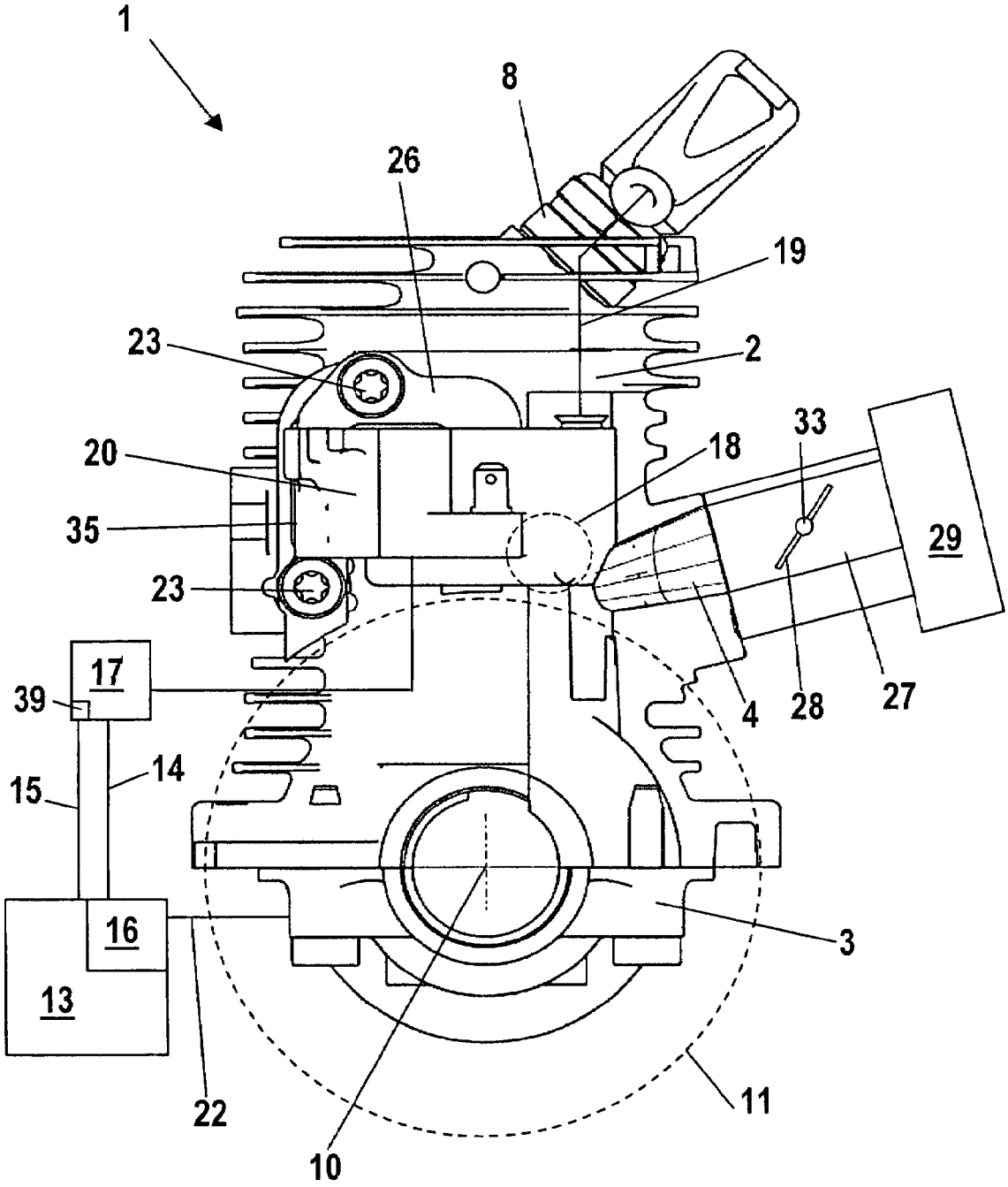
FIG. 2 is a schematic of the two-stroke engine of FIG. 1 viewed in the direction of arrow II in FIG. 1.

As shown in FIG. 2, the ignition module 20 is attached to the cylinder 2 via two attachment screws 23. The position of the electromagnetic valve 18 is indicated in phantom outline in FIG. 2 as is the position of the fan wheel 11. As FIG. 2 shows, an air channel 27 opens at the inlet 4. A throttle flap 28 having a throttle shaft 33 is pivotally journalled in the air channel 27. The quantity of combustion air, which is supplied to the two-stroke engine, can be adjusted via the setting of the throttle flap. An air filter 29 is mounted upstream of the throttle flap 28 and prevents dirt particles from reaching the two-stroke engine 1.

Figure 3:
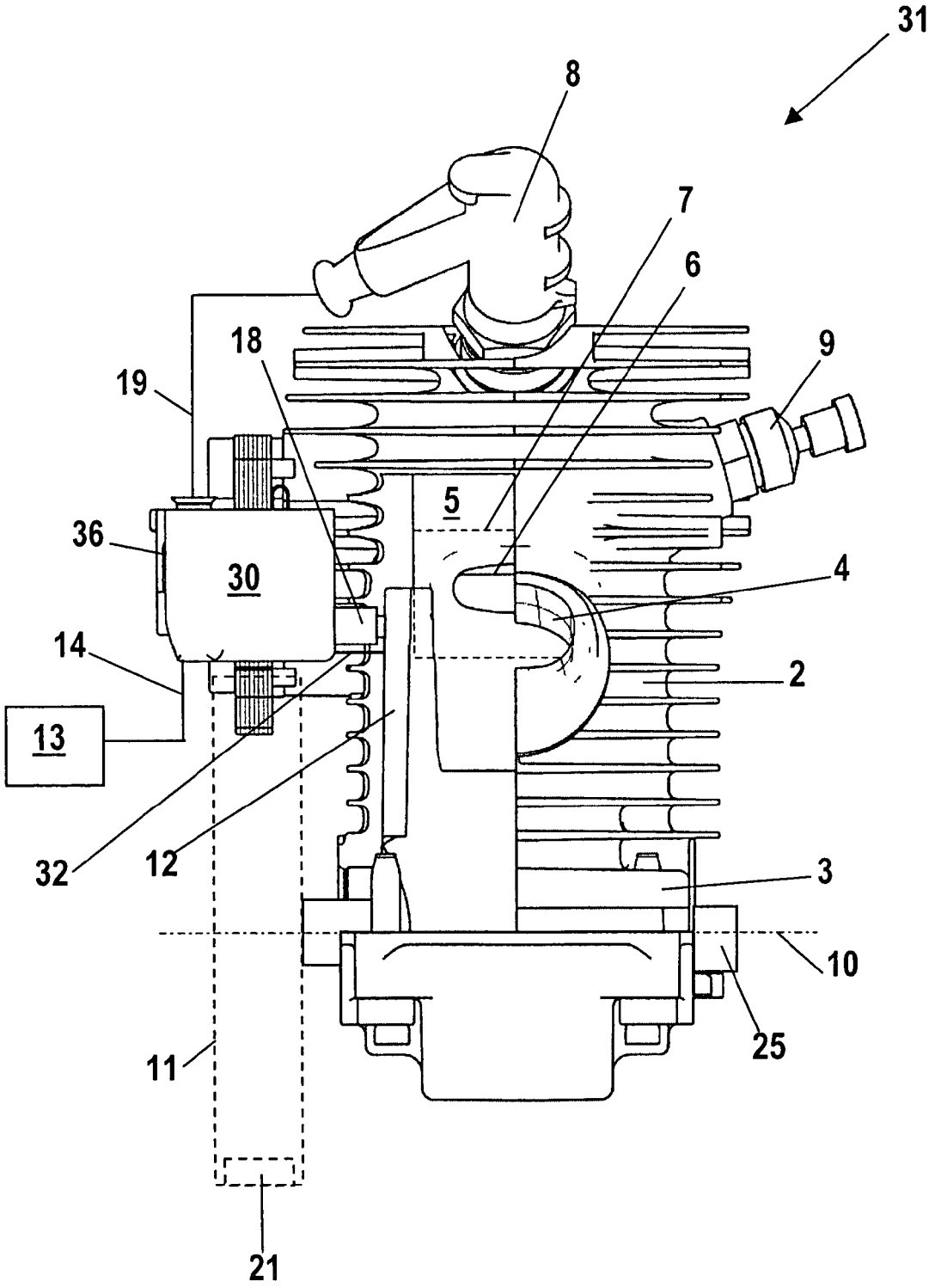
FIGS. 3 and 4 show additional embodiments of the two-stroke engine in views corresponding to that of FIG. 1; and, FIG. 5 is still another embodiment of a two-stroke engine in a view corresponding to that of FIG. 2.

FIG. 3 shows a two-stroke engine 31 having an ignition module 30. The same reference numerals in FIG. 3 show the same parts as in FIGS. 1 and 2. The ignition module 30 is connected directly to the fuel tank 13 via a fuel line 14. In the housing 36 of the ignition module 30, the fuel pump as well as a CPU for controlling the ignition of the spark plug and for controlling the electromagnetic valve 18 are integrated. The ignition module 30 is connected via a pulse line 32 to the transfer channel 12. The pulse line 32 leads to the fuel pump in the ignition module 30. For the assembly of the ignition module 30, the ignition module 30 is screwed tightly to the cylinder 2 and the ignition module 30 is connected to the pulse line 32, the fuel line 14 and the lead 19 for connecting to the spark plug 8. The lead 19 is a high voltage lead. In addition, a connection is provided for a short circuit cable at the ignition module.

Figure 4:
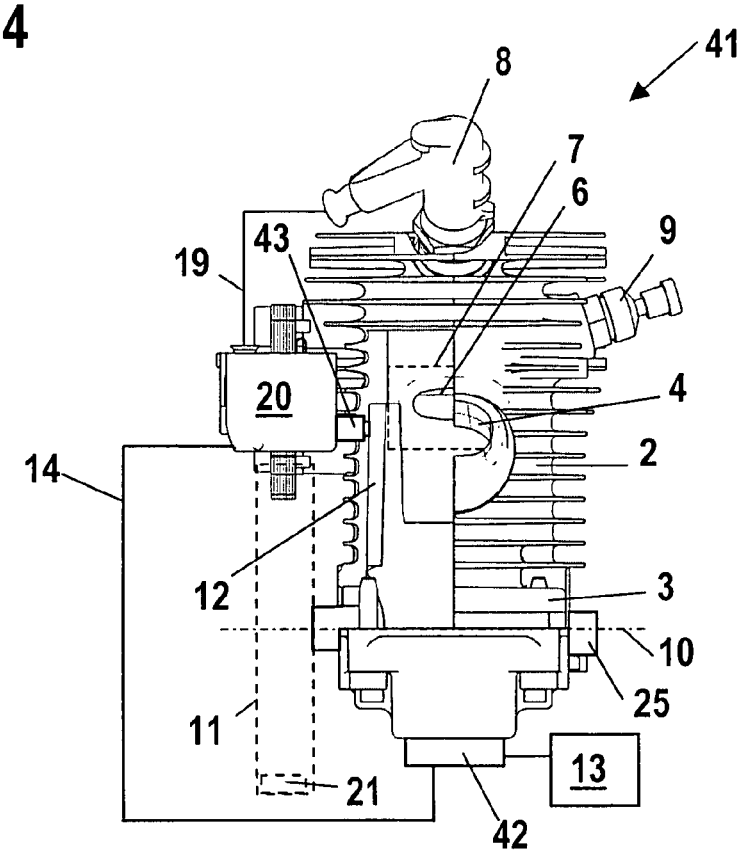

The two-stroke engine 41 shown in FIG. 4 has a fuel pump 42 which is mounted on the crankcase 3. The fuel pump 42 is connected via a pulse line to the crankcase 3. The pulse line is integrated on the fuel pump 42 and/or on the crankcase 3. The fuel pump 42 pumps the fuel from the fuel tank 13 via the fuel line 14 to the ignition module 20. At the ignition module 20, an injection nozzle 43 is integrated which projects into the transfer channel 12. It can be practical that an electromagnetic valve is integrated into the injection nozzle 43. The electromagnetic valve can, for example, be configured as a needle which projects into the injection nozzle. However, a separate electromagnetic valve can also be integrated upstream of the injection nozzle 43 in the ignition module 20.

Figure 5:
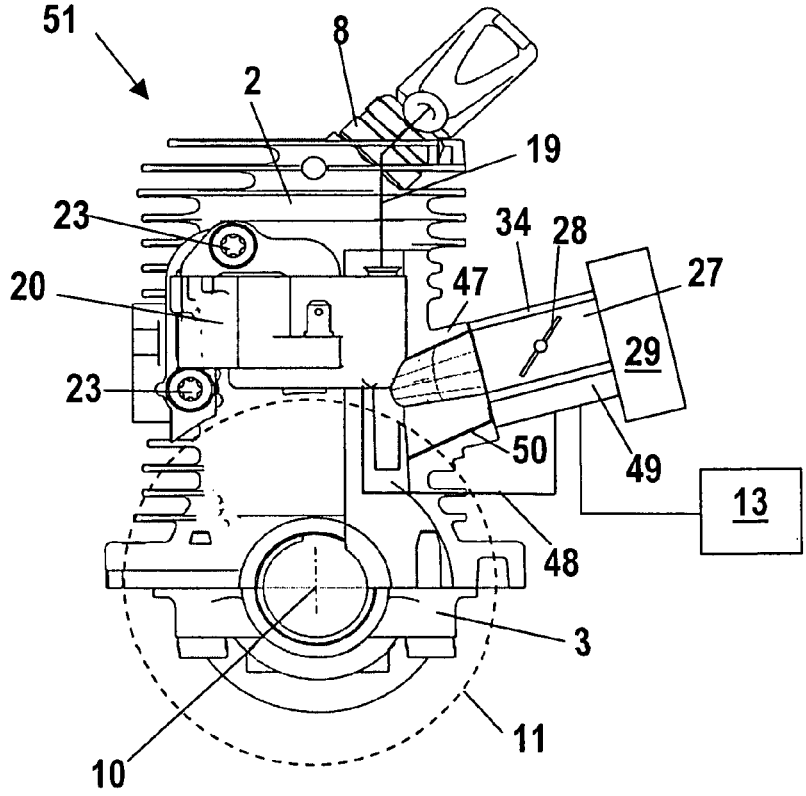

In the two-stroke engine 51 shown in FIG. 5, the fuel pump 49 is mounted on the throttle flap housing 34. The fuel pump 49 pumps the fuel from the fuel tank 13 via the fuel line 48 to the ignition module 20. The fuel pump 49 is connected to the crankcase 3 via a pulse line 50 which is configured in the connecting stub 47 of the cylinder 2. The air channel 27 is connected at the connecting stub 47.

Parts subjected to wear of the electromagnetic valve 18 can be exchanged. Also, the parts subject to wear on the fuel pump, such as the membrane of the fuel pump, are exchangeable. In this way, a long service life of the two-stroke engine is ensured. The air channel 27 can also be connected via valves, for example, check valves, to the transfer channel(s) 12.

It is understood that the foregoing description is that of the preferred embodiments of the invention and that various changes and modifications may be made thereto without departing from the spirit and scope of the invention as defined in the appended claims.

What is claimed is:

1. A two-stroke engine comprising:

a cylinder;

a piston mounted in said cylinder to undergo a reciprocating movement along a stroke path between top dead center and bottom dead center during the operation of said engine;

said cylinder and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug; and, said control unit and said electromagnetic valve being integrated into said ignition module.

2. The two-stroke engine of claim 1, wherein said control unit is part of a central processing unit integrated into said ignition module.

3. The two-stroke engine of claim 1, wherein said ignition module is mounted on said cylinder in the region of said transfer channel.

4. The two-stroke engine of claim 1, further comprising a fuel pump mounted upstream of said electromagnetic valve.

5. The two-stroke engine of claim 4, wherein said fuel pump is a membrane pump which is connected via a pulse line to a region of the two-stroke engine wherein a fluctuating pressure is present.

6. The two-stroke engine of claim 1, wherein said electromagnetic valve is open in the deenergized state.

7. The two-stroke engine of claim 1, wherein said electromagnetic valve projects into said transfer channel.

8. The two-stroke engine of claim 1, further comprising an injection nozzle mounted downstream of said electromagnetic valve; and, said injection nozzle projecting into said transfer channel.

9. The two-stroke engine of claim 8, wherein said electromagnetic valve is integrated into said injection nozzle.

10. A two-stroke engine comprising:

a cylinder;

a piston mounted in said cylinder to undergo a reciprocating movement along a stroke path between top dead center and bottom dead center during the operation of said engine;

said cylinder and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug;

said control unit and said electromagnetic valve being integrated into said ignition module; and, said electromagnetic valve being mounted with the ignition module in a common housing.

11. A two-stroke engine comprising:

a cylinder;

a piston mounted in said cylinder to undergo a reciprocating movement along a stroke path between top dead center and bottom dead center during the operation of said engine;

said cylinder and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug;

said control unit and said electromagnetic valve being integrated into said ignition module; and, said ignition module and said electromagnetic valve being cast with each other.

12. A two-stroke engine comprising:

a cylinder;

a piston mounted in said cylinder to undergo a reciprocating movement along a stroke path between top dead center and bottom dead center during the operation of said engine;

said cylinder and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug;

said control unit and said electromagnetic valve being integrated into said ignition module;

a fuel pump mounted upstream of said electromagnetic valve;

a pressure controller: and, said electromagnetic valve being connected to said fuel pump via said pressure controller.

13. The two-stroke engine of claim 12, wherein said pressure controller is connected via a return line to said fuel tank.

14. A two-stroke engine comprising:

a cylinder;

a piston mounted in said cylinder to undergo a reciprocating movement along a stroke path between top dead center and bottom dead center during the operation of said engine;

said cylinder and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug;

said control unit and said electromagnetic valve being integrated into said ignition module;

a fuel pump mounted upstream of said electromagnetic valve; and, said fuel pump being integrated into said ignition module.

15. The two-stroke engine of claim 14, further comprising a pulse line opening said transfer channel.

16. A two-stroke engine comprising:

a cylinder;

a piston mounted in said cylinder to undergo a reciprocating movement along a stroke path between top dead center and bottom dead center during the operation of said engine;

said cylinder and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug;

said control unit and said electromagnetic valve being integrated into said ignition module;

a fuel pump mounted upstream of said electromagnetic valve; and, said fuel pump being mounted in said fuel tank.

17. The two-stroke engine of claim 16, further comprising a pulse line opening into said crankcase.

18. A two-stroke engine comprising:

a cylinder;

a piston mounted in said cylinder to undergo a reciprocating movement along a stroke path between top dead center and bottom dead center during the operation of said engine;

said cylinder and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug;

said control unit and said electromagnetic valve being integrated into said ignition module;

a fuel pump mounted upstream of said electromagnetic valve; and, said fuel pump being mounted in said crankcase.

19. A two-stroke engine comprising:

a cylinder;

a piston mounted in said cylinder to undergo a reciprocating movement along a stroke path between top dead center and bottom dead center during the operation of said engine;

said cylinger and said piston conjointly delimiting a combustion chamber;

a crankcase connected to said cylinder;

a crankshaft rotatably mounted in said crankcase;

said piston being connected to said crankshaft for imparting rotational movement to said crankshaft;

a fuel tank;

a fuel line for conducting fuel from said fuel tank;

an electromagnetic valve mounted in said fuel line;

an air channel for supplying combustion air to said engine;

a transfer channel for connecting said combustion chamber to said crankcase at pregiven positions of said piston;

a spark plug projecting into said combustion chamber;

a control unit for controlling said electromagnetic valve;

an ignition module for triggering the ignition of said spark plug;

said control unit and said electromagnetic valve being integrated into said ignition module;

a fuel pump mounted upstream of said electromagnetic valve;

a throttle flap housing;

a throttle flap pivotally mounted in said air channel within said housing; and, said fuel pump being mounted in said throttle flap housing.

20. The two-stroke engine of claim 19, wherein said cylinder has a connecting stub for said air channel and a pulse line configured in said connecting stub.

* * * * *